United States Patent [19]

Shore

[11] Patent Number: 4,830,524

[45] Date of Patent: May 16, 1989

[54] RIBBON CARTRIDGE

[75] Inventor: Sydney Shore, Long Island City, N.Y.

[73] Assignee: Typerite Ribbon Manufacturing Corp., Long Island City, N.Y.

[21] Appl. No.: 673,463

[22] Filed: Nov. 20, 1984

[51] Int. Cl.[4] ..... B41J 35/28

[52] U.S. Cl. ..... 400/208; 400/196; 400/248

[58] Field of Search ..... 400/196.1, 208, 247, 400/248, 194, 195, 196, 208.1

[56] References Cited

U.S. PATENT DOCUMENTS

| | | | |
|---|---|---|---|
| 3,726,381 | 4/1973 | Murphy | 400/208 |
| 3,897,866 | 8/1975 | Mueller | 400/208 |
| 4,385,848 | 5/1983 | Camosso | 400/208 |
| 4,496,255 | 1/1985 | Meintrap et al. | 400/208 |

FOREIGN PATENT DOCUMENTS

| | | | |
|---|---|---|---|
| 57-103884 | 6/1982 | Japan | 400/208 |
| 57-138973 | 8/1982 | Japan | 400/208 |

OTHER PUBLICATIONS

"Ribbon Cartridge"; R. D. Mathews; *IBM TDB;* vol. 18, No. 11, p. 3538; Apr. 1976.

*Primary Examiner*—David B. Wiecking

*Attorney, Agent, or Firm*—Sprung Horn Kramer & Woods

[57] ABSTRACT

A ribbon cartridge comprises a housing including a main body with upper and lower substantially planar main surfaces and ribbon inlet and outlet apertures at one side of the main body and two ribbon guide arms extending upwardly and outwardly from the ribbon inlet and outlet apertures at the one side with the termini spaced apart to form a gap and such that the upper and lower surfaces of the ribbon guide arms at the termini thereof are higher than the upper and lower main surfaces respectively.

5 Claims, 2 Drawing Sheets

RIBBON CARTRIDGE

BACKGROUND OF THE INVENTION

The present invention relates to a ribbon cartridge and in particular to a ribbon cartridge holding ¼" ribbon for replacement for a ½" ribbon cartridge.

Currently a popular ribbon cartridge for typewriters, printers and other business machines which include printing mechanisms, is the NEC 3500 series multistrike ribbon cartridge. This ribbon cartridge utilizes a ½" ribbon and has a unique construction wherein the printing mechanism first strikes the upper half of the ribbin surface whereupon the ribbon cartridge is removed, turned upside down and modified in its drive mechanism so that the cartridge can now be reused to print on the other half surface of the ribbon.

While this ribbon cartridge in theory operates well, in practice, there are many disadvantages. Firstly, the ribbon cartridge is extremely complex in construction. Secondly, many users are unaware of the fact that the ribbon cartridge can be turned over and thus after the first pass through the ribbon the cartridge is removed and disposed of, thereby wasting half of the ribbon. Furthermore, the cartridge does not reliably wind the take-up spool during the first pass along the ribbon and thus there is an unreliable winding action in the oppostie direction after the ribbon cartridge has been turned over.

In order to eliminate these disadvantages, a prior art cartridge has been proposed which has the same overall thickness as the original manufacturers cartridge, but which uses a ¼" ribbon which starts at a supply spool, travels through guide arms, angles upwardly across the printing mechanism gap and then returns to a take-up spool which is disposed on top of the supply spool.

This cartridge has the disadvantage that the cartridge housing is unnecessarily bulky, and because the ribbon, as it travels across the gap between the ends of the guide arms, is slightly twisted and thus does not present a reliable impact surface for the printing mechanism.

SUMMARY OF THE INVENITON

The main object of the present invention is to provide a ribbon cartridge which overcomes the disadvantages of the aforesaid prior art cartridges and to provide a ribbon cartridge which is simple in construction and effective in replacing the cartridge now in use.

These and other objects of the present invention are achieved in accordance with the present invention by providing a ribbon cartridge including a housing having a main body with upper and lower substantially planar main surfaces and a ribbon inlet and a ribbon outlet at one side of the main body. Two ribbon guide arms extend upwardly and outwardly from the ribbon inlet and outlet apertures at the one side, with the termini of the guide arms spaced apart to form a gap across which an exposed run of ribbon is formed. The upper and lower surfaces of the ribbon guide arms at the termini thereof are higher than the upper and lower main surfaces respectively of the main body.

In accordance with the present invention the housing has a ribbon supply spool rotatably mounted therein with the upper surface of the ribbon spool disposed in a given plane and means for guiding the ribbon from the supply spool and across the gap to vertically dispose the ribbon across the entire gap with the lower edge of the ribbon substantially in the given plane.

By means of the present invention, the cartridge housing can have the same thickness as a cartridge housing for a ¼" ribbon while the housing effectively raises the level of the ribbon at the gap to the same height as a ½" ribbon.

In accordance with the present invention, beveled guide surfaces are disposed along the guide arms to change the angular orientation of the ribbon as it passes between the supply spool and a take-up spool so that the exposed run of ribbon across the gap is substantially vertical with its lower edge parallel to the plane of the supply spool.

The invention will be better understood from the following description taken in conjunction with the accompanying drawings.

BRIEF DESCRIPTION OF THE DRAWINGS

FIG. 2 is a side view of the cartridge of FIG. 1 with the cover on;

FIG. 3 is a front view of the cartridge of FIG. 1 with the cover on; and FIG. 4 is a sectional view along line IV—IV of FIG. 1 with the cover on.

DETAILED DESCRIPTION OF THE INVENTION

Figure 1:
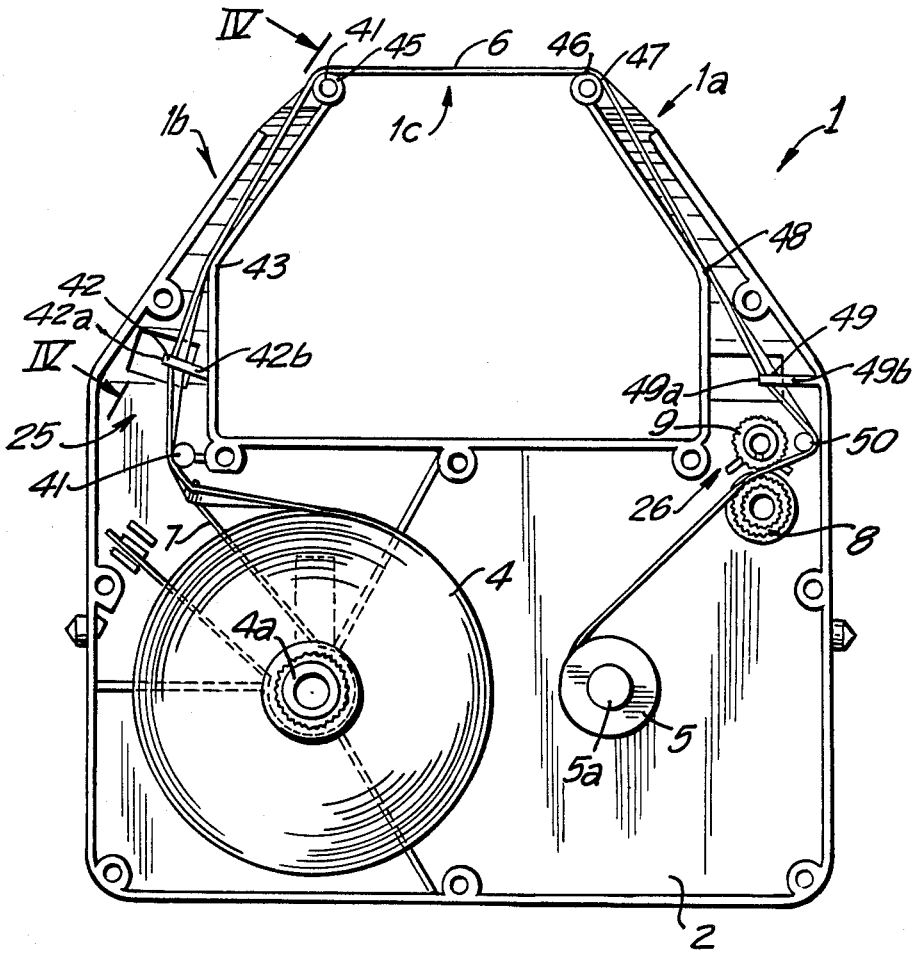
FIG. 1 is a top view of the ribbon cartridge in accordance with the present invention with the cover removed.
Figure 2:
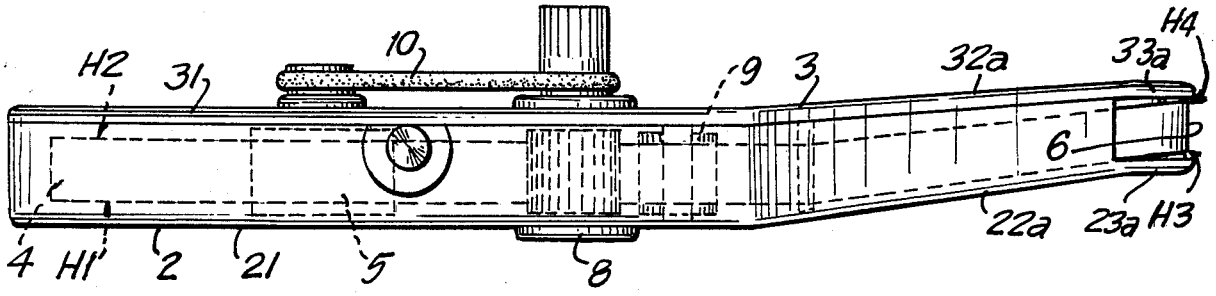

Referring now to FIGS. 1–4, the ribbon cartridge in accordance with the present invention is preferably formed from a lower plastic housing member 2 and a plastic cover member 3. The housing members 2 and 3 have portions 21, 31 which form the main body of the housing in which the supply spool 4 is rotatably mounted and which the take-up spool is rotatably mounted on hubs 4*a* and 5*a* respectively. The cartridge housing members further include guide arms 1*a* and 1*b* which form a gap 1*c* between the ends thereof to expose a run of ribbon 6 for impact by a printing mechanism (not shown).

The supply spool 4 is wound with a ¼" ribbon and is disposed in the form of a "pancake" with its lower edge disposed in plane H1 and its upper edge disposed in plane H2. The ribbon is initially tensioned by a U-shaped spring member 7 and passes through the ribbon outlet 25 into the guide arm 1b across the gap 1c to expose a run 6 of ribbon, through guide arm 1a back into the main body via ribbon inlet 26 and wound onto take-up spool 5 which sits in the same plane as the supply spool 4. The ribbon is driven by drive members 8 and 9 which work in conjunction with the printing mechanism not shown to pull the ribbon from the supply spool and onto the take-up spool.

The present invention includes guide means for raising he level of the ribbon from the take-up spool 4 which is defined by planes H1 and H2 to the level wherein the lower edge of the exposed run of ribbon 6 is at level H3 and the upper edge is at level H4. Preferably, the plane of H3 is at the same level as the plane H2, although some variation is permissible.

This raising of the level of the ribbon across the gap is achieved in part by the configuration of the guide arms 1*a* and 1*b*. Specifically, the lower surface of the guide arm 1*a* has a portion 22*a* and 32*a* which extend upwardly and outwardly from the side of the main body at the ribbon inlet 26 and then terminate with a portion 23*a* and 33*a* which is substantially parallel to surfaces 21 and 31 but are at a higher level than surfaces 21 and 31 respectively. Similarly, guide arm 1*b* has surfaces 22*b*, 32*b*, and 23*b*, 33*b* extending outwardly from ribbon outlet 25.

While the sloping surfaces of the guide arms achieve the raising of the ribbon to the new height, this alone will not ensure the fact that the ribbon be at least substantially, but preferably perfectly vertical at the exposed run of ribbon 6 and that the lower edge of run 6 as well as the upper edge of run 6 be disposed at planes H3 and H4 along their entire length. This alignment of the run of ribbon 6 is achieved by guide means including guide surfaces 41–50 against which the ribbon abuts during its path between the supply spool and the take-up spool.

Among the guide surfaces 41–50 are beveled guide members 42, 44–47 and 49 which change the angular orientation of the ribbon in a way which achieves the desired vertical orientation of the run of ribbon 6 at the gap.

Figure 3:
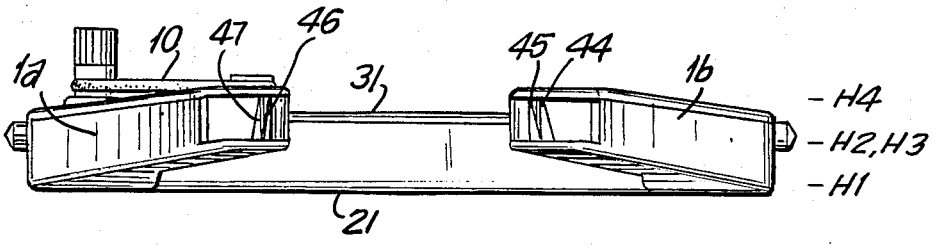
Figure 4:
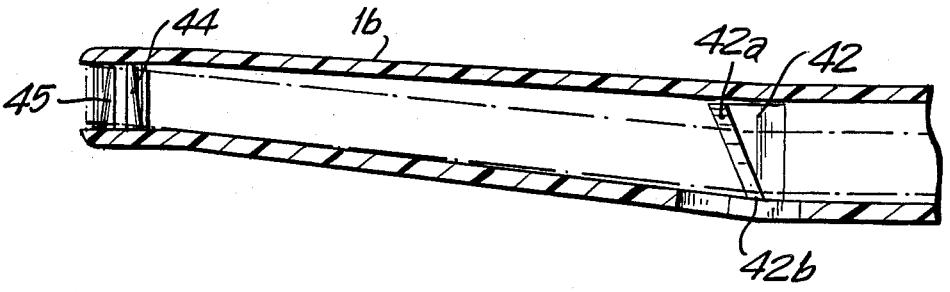

The angular orientation of the beveled guide members are shown in more detail in FIGS. 3 and 4, with guide members 42 and 49 having beveled surfaces between edges 42*a* and 42*b* and 49*a* and 49*b* respectively as shown in FIGS. 1 and 4.

Guide members 42, 44–47 and 49 act to twist the ribbon out of its normal orientation to achieve the vertical alignment that is desired.

It will be appreciated that the instant specification and claims are set forth by way of illustration and not limitation, and that various modifications and changes may be made without departing from the spirit and scope of the present invention.

What is claimed is:

1. A ribbon cartridge housing comprising:

a main body having an upper and lower substantially planar parallel main surfaces and ribbon inlet and outlet apertures at one side thereof;

two spaced apart ribbon guide arms extending upwardly and outwardly from the ribbon inlet and outlet apertures to form a gap at the termini thereof and each arm including a first portion having upper and lower substantially planar first surfaces extending continuously from the upper and lower main surfaces at an angle thereto, a second portion at the terminus thereof having upper and lower substantially planar second surfaces extending continuously from the first surfaces and disposed parallel to and higher than the upper and lower main surfaces and beveled guide surfaces disposed at the second portion of the guide arms and configured to change the angular orientation of a ribbon guided thereon to dispose the ribbon perpendicular to the upper and lower second surface across the entire gap.

2. The housing according to claim 1, further comprising means for rotatably mounting a ribbon supply spool and a ribbon take-up spool side-by-side and at the same level in the main body between the upper and lower main surfaces.

3. The housing according to claim 2, wherein the guide arms are configured to dispose a ribbon extending across the gap at a level wherein the lower edge thereof is at substantially the same height as the upper edge of ribbon on mounted supply and take-up spools.

4. A ribbon cartridge comprising:

a main body having upper and lower substantially planar parallel main surfaces and ribbon inlet and outlet apertures at one side thereof and a ribbon supply spool and a ribbon take-up spool rotatably mounted side-by-side and at the same level in the main body between the upper and lower main surfaces;

two spaced apart ribbon guide arms extending upwardly and outwardly from the ribbon inlet and outlet apertures to form a gap at the termini thereof and receptive of ribbon from the supply spool to guide same across the gap to the take-up spool, each arm including a first portion having upper and lower substantially planar first surfaces extending continuously from the upper and lower main surfaces at an angle thereto, a second portion at the terminus thereof having upper and lower substantially planar second surfaces extending continuously from the first surfaces and disposed parallel to and higher than the upper and lower main surfaces and beveled guide surfaces disposed at the second portion of the guide arms and configured to change the angular orientation of the ribbon guided thereon to dispose the ribbon perpendicular to the upper and lower second surface across the entire gap.

5. The ribbon cartridge according to claim 4, wherein the guide arms are configured to dispose the ribbon extending across the gap at a level wherein the lower edge thereof is at substantially the same height as the upper edge of the ribbon on the supply and take-up spools.

* * * * *